US005694138A

United States Patent [19]

Crosby

[11] Patent Number: 5,694,138

[45] Date of Patent: Dec. 2, 1997

[54] ANTENNA HEATER POWER THROUGH COAX

[75] Inventor: Jeffrey W. Crosby, Sherman Oaks, Calif.

[73] Assignee: HE Holdings, Inc., Los Angeles, Calif.

[21] Appl. No.: 607,743

[22] Filed: Feb. 27, 1996

[51] Int. Cl.[6] ..... H01Q 1/02

[52] U.S. Cl. ..... 343/704; 343/905

[58] Field of Search ..... 343/706, 713, 343/840, 905; 219/209; 392/422

[56] References Cited

U.S. PATENT DOCUMENTS

| | | | |
|---|---|---|---|
| 2,679,004 | 5/1954 | Dyke et al. | 343/704 |
| 4,063,247 | 12/1977 | Sakurai et al. | 343/704 |
| 4,070,677 | 1/1978 | Meinke et al. | 343/704 |
| 4,086,594 | 4/1978 | Kropielnicki et al. | 343/704 |
| 4,213,029 | 7/1980 | Endicott, Jr. et al. | 343/704 |
| 4,439,771 | 3/1984 | Kume et al. | 343/704 |

FOREIGN PATENT DOCUMENTS

| | | | |
|---|---|---|---|
| 0065033 | 4/1982 | Japan | 343/704 |
| 0214604 | 10/1985 | Japan | 343/704 |
| 0097101 | 4/1990 | Japan | H01Q 1/02 |
| 4253401 | 9/1992 | Japan | H01Q 1/02 |

*Primary Examiner*—Donald T. Hajec
*Assistant Examiner*—Tan Ho
*Attorney, Agent, or Firm*—John A. Crook; Phyllis Y. Price; Terje Gudmestad

[57] ABSTRACT

A method and system that provides power to an antenna clearing device through a coaxial cable used to transmit the satellite signals is disclosed. Receiver decoder box for receiving satellite signals via an LNB is connected to the LNB by the coaxial cable. The antenna clearing device is also connected to the coaxial cable. A power source within the box provides power to the LNB and the antenna clearing device via the coaxial cable.

12 Claims, 2 Drawing Sheets

ANTENNA HEATER POWER THROUGH COAX

BACKGROUND OF THE INVENTION

The present invention relates generally to satellite communications systems, and more particularly to a system and method for powering an antenna clearing device that does not require costly and unsightly extra power cords or solar panels.

Generally, in digital satellite communications systems, a ground-based transmitter beams a forward error coded uplink signal to a satellite positioned in a geosynchronous orbit. The satellite relays the signal back to a ground-based receiver antenna in a separate location. Direct broadcast satellite ("DBS") systems allow households to receive television, audio, data and video directly from the DBS satellite. Each household subscribing to the system receives the broadcast signals through a receiver unit and a satellite dish antenna.

In the typical DBS system, the satellite receiver antenna includes an 18-inch parabolic dish, and the receiver unit is a television set-top decoder module, or "IRD". The receiver antenna is mounted outside the house, and a coaxial cable is provided to link the antenna to the indoor IRD and television. Snow, ice or other debris can accumulate on the receiver antenna, especially in colder climates. The accumulated debris can degrade the received signal strength enough to interrupt IRD operation.

Various means to clear the snow, ice or debris exist, such as blown heat, radiative elements or convection systems. However, all these clearing devices require power to operate. Each of these clearing devices requires either an unsightly and costly solar panel or an unsightly and costly power cord to operate. Any unsightly power cords are run either inside the house or to an outside outlet.

Therefore, there is a need for a system and method for powering clearing devices which do not require costly or unsightly extra power cords or solar panels.

SUMMARY OF THE INVENTION

The preferred embodiments of the instant invention address this need by providing a system that provides power to antenna clearing equipment mounted on a satellite receiver antenna. The system includes a powered clearing device connected to the antenna, a cable connected to the antenna and the powered clearing device, and a power source connected to the cable for providing power signals via the cable to the powered clearing device. The power source may be located within a satellite decoder. The cable transmits power signals to the powered clearing device, and also transmits signals received from the antenna. The decoder combines the power signal with the signals received from the antenna and transmits the combined signal on a coaxial cable. The signal is then split, so that the power signal powers the clearing device.

In another aspect of the invention, a method for providing power to a clearing device mounted on a satellite receiver antenna includes the steps of providing a cable connected to the antenna and the clearing device with the other end of the cable connected to a power source, transmitting signals received at the antenna and power signals from the power source on the cable, and powering the clearing device with the power signals from the cable.

The preferred embodiment of this system and method powers a satellite antenna heating device to melt snow or frost accumulated on the antenna. The power is provided in the same cable used to transmit the signals received by the antenna, thus avoiding the use of multiple cables.

It is to be understood that both the foregoing general description and the following detailed description are exemplary and are intended to provide further explanation of the invention as claimed. The invention, together with further objects and attendant advantages, will be best understood by reference to the following detailed description in conjunction with the attached drawings.

DETAILED DESCRIPTION OF THE PRESENTLY PREFERRED EMBODIMENTS

Figure 1:
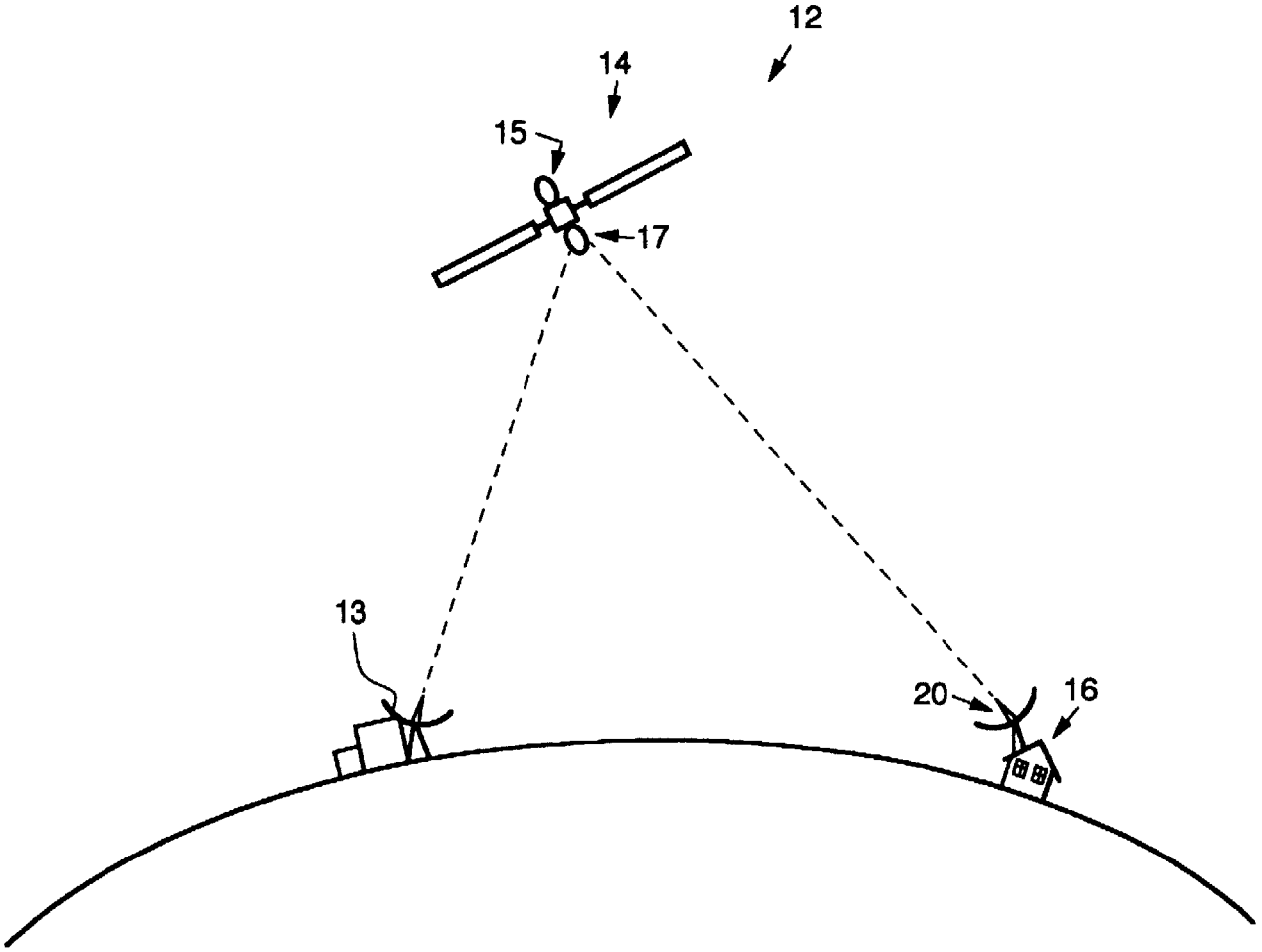
FIG. 1 illustrates a conventional direct-to-home DBS satellite television system capable of utilizing an antenna heater powered through a coaxial cable.

Referring now to the drawings, and more particularly to FIG. 1, a digital DBS system 12 capable of utilizing the present invention is shown. The DBS system 12 preferably includes a ground-based broadcast transmitter 13, a space segment 14 that includes a satellite 15, and a ground-based subscriber receiving station 16. In an exemplary DBS system, the satellite 15 is a geosynchronous satellite, such as the Hughes® HS-601™ spacecraft, positioned at a geosynchronous orbital location at approximately 101° W longitude. The home subscriber receiving station 16 includes an outdoor satellite receiver dish antenna 20 connected to an indoor integrated receiver/decoder ("IRD") (not shown) via a cable (also not shown).

The broadcast transmitter 13 receives digitally modulated television or audio signals and beams them at 17.3–17.8 GHz to the satellite 15. The satellite 15 translates the signals to 12.2–12.7 Ghz, then beams them to the satellite receiver dish antenna 20 of the receiving station 16 for subsequent demodulation. The satellite 15 transmits downlink signals via on-board transponders 17 operating at a power level of 120 to 240 watts. For a typical DBS system, the air uplink to the satellite has a 24 Mhz band rate, a 20M symbols forward/Sec Symbol rate, and a 40 Mbps total bit rate.

Figure 2:
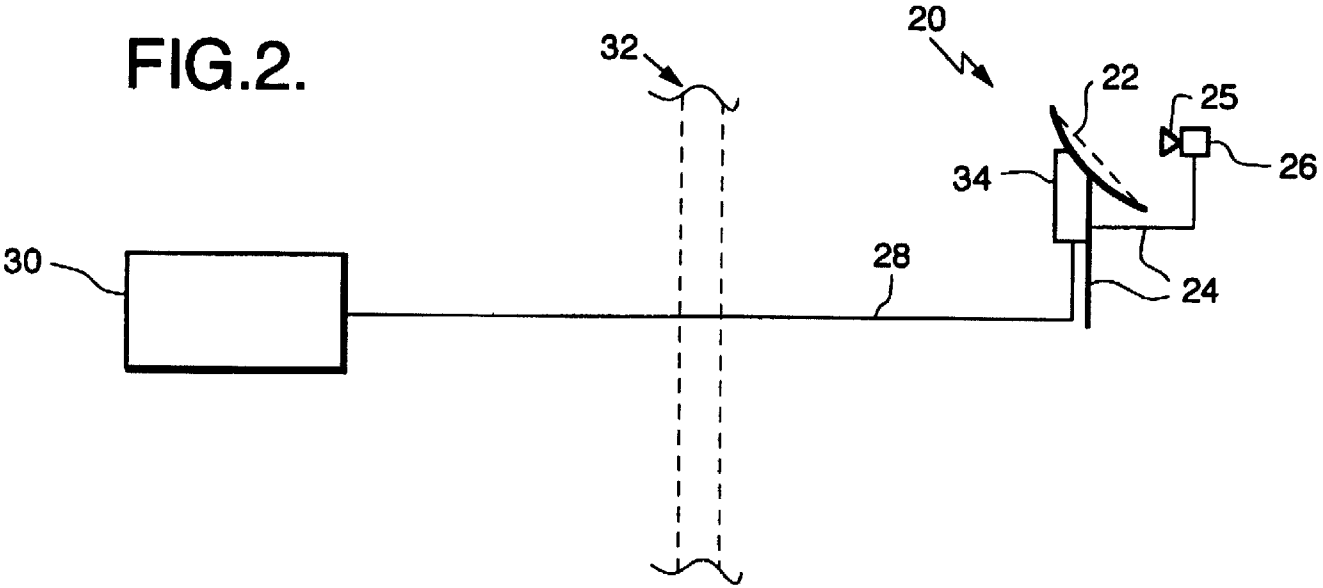
FIG. 2 is an IRD connected by a cable to a satellite receiver dish antenna.

Referring now to FIG. 2, a preferred embodiment of the antenna clearing system hardware is shown. Most of the hardware is mounted on or near the satellite receiver dish antenna shown generally at 20. The satellite receiver dish antenna 20 includes a parabolic dish 22, a mounting bracket 24, a feedhorn 25 and a Low-Noise Block ("LNB") 26.

Signals from the satellite are received at the parabolic dish 22 which focuses those signals by reflecting them to the feedhorn 25. The feedhorn 25 is a waveguide positioned at the focal point of the dish 22 to receive the reflected focused signals and is well known in the art. The feedhorn 25 directs the concentrated signals to a probe (not shown) which responds to the focused signals by producing a small electrical signal. Preferably, the feedhorn 25 has a generally circular cross-section for receiving DBS system circularly polarized signals. The LNB 26 receives the signals from the feedhorn 25. The LNB 26 amplifies and down converts the signals to a one Ghz general range, and transmits the signals via coaxial cable 28 to the IRD 30. An RG-6 coaxial cable is preferred, but other cables may be used. The cable 28 typically runs from the satellite receiver dish antenna 20 through the wall of a structure, generally shown at 32, to the IRD 30 located inside the structure.

The clearing device 34 may utilize various heating methods to clear the antenna 20. These methods include blown heat, radioactive elements, convection systems or any other means to clear debris from the antenna 20. Preferably, the clearing device 34 is a low voltage, low wattage resistive device with few or no moving parts. The clearing device 34 may be a conventional heating element of the type used to remove snow, frost, and/or ice, like from an outdoor antenna unit. The clearing device 34 is mounted onto the antenna 20 by means known in the art which will allow operation of the clearing element 34 without inhibiting the reception by the antenna 20.

Figure 3:
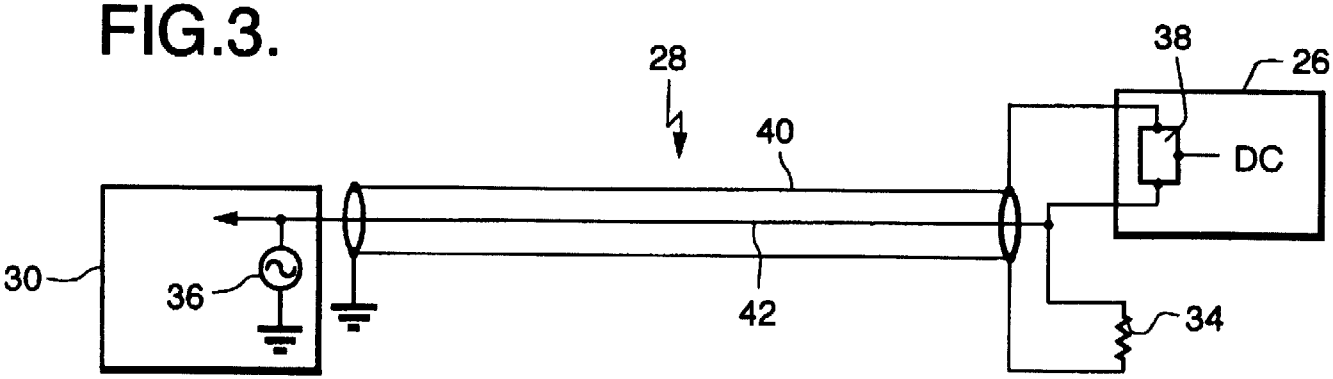
FIG. 3 is an electrical schematic of the antenna heater powered through a cable.

An electrical system for powering the clearing device according to the present invention is shown in FIG. 3. A power source 36 is located within the IRD 30. The power source 36 may be a battery, wall socket connection or even external to the IRD as long as it is capable of providing power to the cable 28. The power source 36 may provide either a DC or an AC signal. Preferably, the power source provides DC power. The power source 36 supplies a 13 or 17 volt polarity selection to the LNB 26 for operation of the antenna 20. Power is also provided to the LNB 26 and the clearing device 34 for their operation. The power source must be able to provide the wattage required to operate both the LNB 26 and the clearing element 34.

If an AC signal is used, the signal is preferably 60 Hz. A filter 38 is provided in the LNB 26 to remove the 60 Hz signal for proper operation of the antenna 20.

The power signal is transmitted through the coaxial cable 28, which also transmits the signal received from the LNB 26. The outer conductor 40 of the coaxial cable is grounded so that the entire signal carried within the coaxial cable will be fully reflected, as is well-known by a person skilled in the art.

The LNB 26 and clearing device 34 are connected in parallel to one end of the coaxial cable 28. The parallel connection splits the current on the coaxial cable so that the 13/17 volt polarity selection is maintained for operation of the antenna 20. This split allows input signals from the LNB 26 onto the coaxial cable and provides power from the coaxial cable to the clearing device 34, which is preferably a resistive heating element. The clearing device 34 is operable with either the 13 or 17 volt input. The satellite signal placed on cable 28 will not impede the operation of the clearing device 34. The power signal is used to power the clearing device 34 so that the antenna (not shown) may be kept free from debris and to power the LNB 26.

The clearing device 34 may be equipped with an on/off switch or other logic devices to monitor and control its operation.

The method and system of the present invention allows a satellite receiver station, in a system such as a direct-to-home DBS system, to conveniently power a clearing device on the satellite dish antenna without the use of extra cables or cords. This system may be designed to operate independently of the IRD, so that the antenna can be maintained in a thawed state even when the IRD is turned off.

Of course, it should be understood that a wide range of changes and modifications can be made to the preferred embodiment described above. For example, varying locations of the power source may be used. The system may be made integral with the IRD or may be sold as an addition. If used as an addition, it is understood that a cord from the power source to a plug-in may be necessary while still incorporating the benefits of this invention. Thus, it is intended that the foregoing detailed description be regarded as illustrative rather than limiting.

It is the following claims, including all equivalents, which are intended to define the scope of this invention.

We claim:

1. A system for providing power to antenna clearing equipment mounted on a satellite receiver antenna having an electrically powered receiver device, the system comprising:

a clearing device operatively connected to the antenna;

a cable for transmitting signals received by the antenna having first and second ends, wherein the first end is operatively connected to the antenna and the clearing device; and a power source operatively connected to the cable second end for simultaneously providing power signals on the cable to the receiver device and to the clearing device via the cable.

2. The system of claim 1 wherein the clearing device is a resistive heating device.

3. The system of claim 1 wherein the power signal is a low power alternating current.

4. The system of claim 3 wherein a filter is operatively connected to the receiver device of the antenna to filter the power signal.

5. The system of claim 1 wherein the power signal is a low power direct current.

6. The system of claim 1 wherein the cable is a coaxial cable.

7. The system of claim 6 wherein a satellite decoder is operatively connected to the cable second end.

8. The system of claim 7 wherein the power source is within the satellite decoder.

9. The system of claim 1, wherein the clearing device and the receiver device are connected to the power source in parallel to one another.

10. A method for providing power to a clearing device mounted on a satellite receiver antenna having an electrically powered receiver device, the method comprising the steps of:

providing a cable having first and second ends, wherein the first end is operatively connected to the receiver device of the antenna and to the clearing device, and the second end is operatively connected to a power source;

simultaneously transmitting signals received at the antenna and power signals from the power source on the cable; and powering the receiver device and the clearing device with the power signals from the cable.

11. The method of claim 10 further comprising the step of filtering the power signal from the signals transmitted on the cable at the receiver device.

12. A system for providing power to antenna clearing equipment mounted on a satellite receiver antenna, the system comprising:

a clearing device operatively connected to the antenna;

a coaxial cable having first and second ends for transmitting signals received by the antenna, wherein the first end is operatively connected to the antenna and to the clearing device; and a power source operatively connected to the second end of the coaxial cable for providing power signals on the coaxial cable to the clearing device.

* * * * *